US009091282B2

(12) United States Patent
Mueller et al.

(10) Patent No.: US 9,091,282 B2
(45) Date of Patent: Jul. 28, 2015

(54) HYDRAULIC ARRANGEMENT

(75) Inventors: Matthias Mueller, Langenau (DE); Peter Schmuttermair, Gessertshausen (DE)

(73) Assignee: Robert Bosch GmbH, Stuttgart (DE)

( * ) Notice: Subject to any disclaimer, the term of this patent is extended or adjusted under 35 U.S.C. 154(b) by 485 days.

(21) Appl. No.: 13/517,994

(22) PCT Filed: Nov. 19, 2010

(86) PCT No.: PCT/EP2010/007035

§ 371 (c)(1),
(2), (4) Date: Aug. 28, 2012

(87) PCT Pub. No.: WO2011/076319

PCT Pub. Date: Jun. 30, 2011

(65) Prior Publication Data

US 2012/0317966 A1 Dec. 20, 2012

(30) Foreign Application Priority Data

Dec. 23, 2009 (DE) ..... 10 2009 060 225

(51) Int. Cl.

| | |
|---|---|
| ***F16D 31/02*** | (2006.01) |
| ***F15B 1/033*** | (2006.01) |
| ***F15B 1/02*** | (2006.01) |
| ***F15B 21/14*** | (2006.01) |

(52) U.S. Cl.

CPC ..... *F15B 1/033* (2013.01); *F15B 1/024* (2013.01); *F15B 21/14* (2013.01); *F15B 2211/212* (2013.01); *F15B 2211/625* (2013.01); *F15B 2211/6309* (2013.01)

(58) Field of Classification Search

CPC ..... F15B 1/024; F15B 1/027; F15B 1/033; F15B 21/14; F15B 2211/625; F15B 2211/6309; E02F 9/2217

USPC ..... 60/413, 414, 418, 435, 445

See application file for complete search history.

(56) References Cited

U.S. PATENT DOCUMENTS

| | | | | |
|---|---|---|---|---|
| 2,984,965 | A * | 5/1961 | Lepoutre et al. | 60/414 |
| 5,784,883 | A | 7/1998 | Ohkura et al. | |
| 6,789,387 | B2 * | 9/2004 | Brinkman | 60/414 |

FOREIGN PATENT DOCUMENTS

| | | | |
|---|---|---|---|
| DE | 198 42 534 | A1 | 2/2000 |
| DE | 101 20 113 | A1 | 10/2002 |
| EP | 1 696 136 | A2 | 8/2006 |
| FR | 2 903 155 | A1 | 1/2008 |

OTHER PUBLICATIONS

International Search Report corresponding to PCT Application No. PCT/EP2010/007035, mailed Mar. 4, 2011 (German and English language document) (8 pages).

* cited by examiner

*Primary Examiner* — Michael Leslie
(74) *Attorney, Agent, or Firm* — Maginot, Moore & Beck LLP

(57) ABSTRACT

A hydraulic arrangement includes at least one pressure unit connected to a hydraulic machine that is operable as a pump and a safety device for the pressure unit. The safety device includes pressure sensors configured to detect a pressure in the pressure unit and an electronic control unit that is connected to the pressure sensors. A delivery volume pumped by the hydraulic machine is configured to be controlled via the control unit.

7 Claims, 1 Drawing Sheet

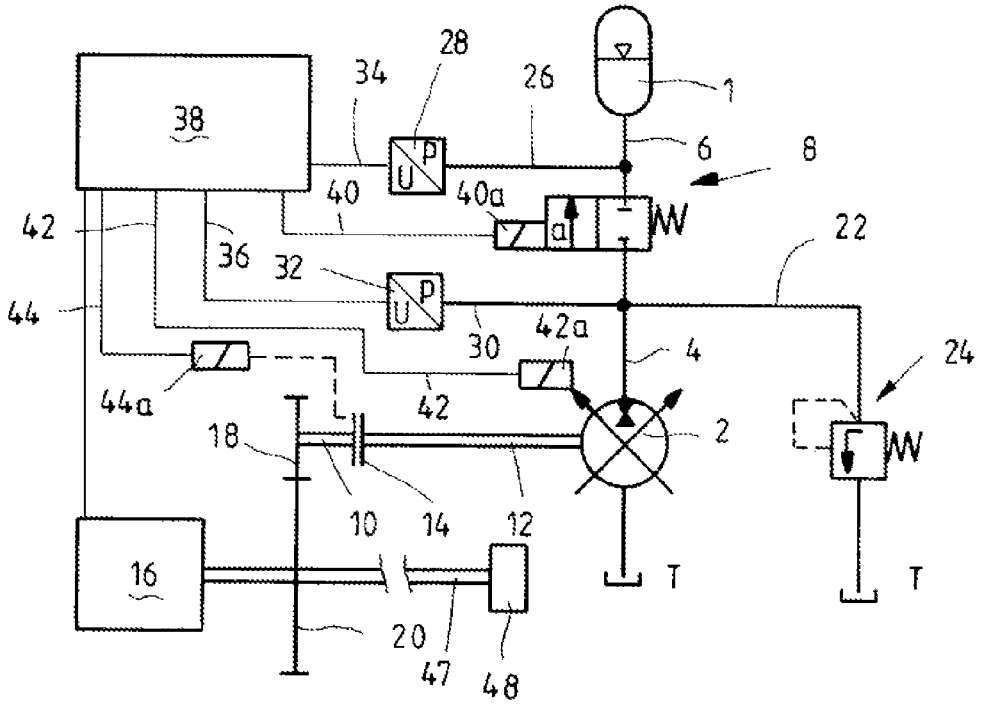
38
34
28
26
1
6
8
40
40a
42
36
32
22
44
30
42a
4
24
44a
42
18
2
10
14
12
16
T
T
20
47
48

HYDRAULIC ARRANGEMENT

This application is a 35 U.S.C. §371 National Stage Application of PCT/EP2010/007035, filed on Nov. 19, 2010, which claims the benefit of priority to Serial No. DE 10 2009 060 225.9, filed on Dec. 23, 2009 in Germany, the disclosures of which are incorporated herein by reference in their entirety.

The disclosure concerns hydraulic arrangements with pressure vessels. In particular the pressure vessel is a hydropneumatic accumulator (hydraulic accumulator).

To limit the maximum pressures of pressure vessels, according to the prior art pressure-limiting valves are used. Under certain circumstances (e.g. in hydraulic accumulators) such a pressure limitation is also legally prescribed (see Directive 79/23/EC).

Pressure-limiting valves open at a predetermined pressure and do not allow the pressure in the pressure vessel to rise further, so that damage (e.g. bursting) and resulting injuries are avoided. Pressure-limiting valves are exposed to the pressure to be limited in the opening direction while they are pressurized usually by spring force in the closing direction. If the pressure to be limited or the compressive force applied thereby to a control surface of a valve body exceeds the spring force, the pressure-limiting valve opens. Pressure medium delivered further flows to a tank and hence away from the pressure vessel to be secured.

The disadvantage with pressure limitation via a pressure-limiting valve is that a precontrolled pressure-limiting valve such as is normally used is extremely expensive and requires a large installation space.

In this context the object of the disclosure is to create a hydraulic arrangement with at least one pressure vessel with a safety device for which the cost of installation and regular testing is low, which requires little installation space and is economic.

This object is achieved by a hydraulic arrangement according to the disclosure.

SUMMARY

The hydraulic arrangement according to the disclosure has at least one pressure vessel connected with a hydraulic machine operable as a pump. Furthermore it has a safety device which comprises a pressure sensor assembly for detecting a pressure in the pressure vessel and an electronic control unit connected with the pressure sensor assembly, via which the delivery quantity output by the hydraulic machine can be controlled. Thus a safety device is created for the pressure vessel which by running down the hydraulic machine does not allow the pressure to exceed the permitted value and hence protects the pressure vessel and the environment from damage. Thus in a simple manner, the maximum pressure can be predetermined and changed via the electronic control unit. The maximum pressure can for example be 325 bar.

Further advantageous embodiments of the disclosure are described in the dependent claims.

To maximize the reliability of the safety device according to the disclosure, a particularly preferred refinement of the pressure sensor assembly has two redundant pressure sensors both allocated to the pressure vessel.

The hydraulic machine can be driven by a motor, wherein the motor is connected with the control unit and can be controlled by this. When a maximum permitted pressure is reached, the motor can be switched off and hence the further charging of the pressure vessel terminated. Switching off before reaching the maximum permitted pressure takes into account any run-on of the motor.

The motor can be an internal combustion engine e.g. a diesel engine, or an electric motor.

In a particularly preferred refinement of the hydraulic arrangement according to the disclosure, a drive and the hydraulic machine are connected together via a coupling, wherein the coupling is connected with the control unit and can be controlled by this. Thus when a maximum pressure is reached or shortly before it is reached, the coupling can be opened and thus the further charging of the pressure vessel terminated. A hydraulic arrangement of the type described is used in particular also as a hydraulic regenerative brake system in vehicles. On braking, the entire vehicle can be regarded as a drive for the hydraulic machine. Kinetic energy is then converted into pressure energy.

In a particularly preferred refinement, the hydraulic machine is an adjusting mechanism which is connected with the control unit and the pivot angle of which can be controlled by this. Thus when a maximum pressure is reached or shortly before this is reached, the hydraulic machine can be set to stroke volume zero in the sense of pivoting back, and hence an increase in pressure in the pressure vessel beyond the maximum permitted pressure can be avoided.

In a variant of the hydraulic arrangement according to the disclosure, the pressure vessel is a hydropneumatic high-pressure accumulator which is connected with the hydraulic machine via a high-pressure line. If a shut-off valve is arranged in the high-pressure line, preferably a pressure sensor assembly is connected both before and after the shut-off valve.

BRIEF DESCRIPTION OF THE DRAWING

An embodiment example of the disclosure is described in detail below with reference to a single FIGURE.

The FIGURE shows an embodiment example of a hydraulic arrangement according to the disclosure wherein only a part of the arrangement essential to the disclosure is shown.

DETAILED DESCRIPTION

The disclosure has a high-pressure accumulator 1 which is filled with pressure medium (hydraulic oil) by an adjustable hydraulic machine 2 via a high-pressure line 4, 6 when the hydraulic machine is driven as a pump. The hydraulic machine 2 then sucks in pressure medium from a tank T. In the high-pressure line 4, 6 is arranged a shut-off valve 8 formed as a 2/2-way valve.

The hydraulic machine 2 can be driven via a drive shaft 10, 12 wherein a coupling 14 is provided between the two segments 10, 12 of the drive shaft.

The drive shaft segment 10 is driven by a diesel engine 16 or via a gear shaft 47 by the inert mass 48, for example by a vehicle via its wheels, via a gear system which substantially comprises two intermeshing spur gears 18, 20. When driven by the vehicle, this is braked and its kinetic energy is converted fully or partly into pressure energy.

In segment 4 of the high-pressure line which connects the hydraulic machine 2 with the shut-off valve 8, a pressure-limiting valve 24 is connected via a pressure-limiting line 22, via which the segment 4 of the high-pressure line can be drained to tank T. A valve body of the pressure-limiting valve 24 is here exposed to the pressure of the pressure-limiting line 22 in the opening direction and to the force of a spring in the closing direction. The pressure-limiting valve 24 serves as a hydraulic resistance for the delivering hydraulic machine 2 when the high-pressure accumulator 1 is full and further braking is to be performed with the hydraulic machine 2. The pressure-limiting valve 24 is set to a lower pressure value than the pressure at which the safety device responds.

The shut-off valve 8 in a spring-pretensioned base position shuts off the high-pressure line 4, 6 while in a switch position marked a it connects the two segments 4, 6 of the high-pressure line so that the high-pressure accumulator 1 can be supplied or filled by the adjusting pump 2.

The pressure in the high-pressure accumulator 1 is monitored and where applicable a further pressure rise in the high-pressure accumulator 1 is prevented according to the disclosure by a safety device with an electronic pressure shut-off. For this a pressure sensor 28 is connected via a connecting line 26 to the segment 6 of the high-pressure line on the accumulator side, and a pressure sensor 32 is connected via a connecting line 30 to the segment 4 of the high-pressure line on the machine side. The pressure sensors 28, 32 are connected via electric pressure indication lines 34, 36 to an electronic control unit 38. Furthermore the control unit 38 is connected via an electric line 40 with an actuator 40*a* of the shut-off valve 8, via an electric line 42 with an actuator unit 42*a* of the pump 2, and via an electric line 44 with an actuator unit 44*a* of the coupling 14.

The legally required pressure limitation in the high-pressure accumulator 1 or a pressure shut-off in the sense of preventing a further pressure rise is guaranteed in that the pressure in segment 6 of the high-pressure line and hence the pressure in the high-pressure accumulator 1 is measured continuously via the pressure sensor 28. These values are transmitted via the electric pressure indication line 34 to the control unit 38 and continuously compared with a prespecified maximum value. Even at a certain distance from the maximum value, redundantly firstly a signal is given via the electric line 42 to the actuator unit 42*a* to pivot back the hydraulic machine 2 and secondly a signal is given via the electric line 44 to the actuator unit 44*a* to open the coupling 14. Thus the supply of pressure medium is terminated and the pressure in the hydraulic accumulator to be monitored does not rise beyond the maximum value. This is ensured redundantly by the opening of the coupling and by the pivoting back of the hydraulic machine 2.

The pressure in the segment 6 of the high-pressure line or in the high-pressure accumulator 1 can also be measured redundantly via two pressure sensors 28 with correspondingly two pressure indication lines 34. The pressure exceedance can then be stored permanently in the control unit 38 e.g. until a service is carried out.

On establishing the response pressure at which the coupling 14 opens and the hydraulic machine 2 is pivoted back, a time period of an opening of the coupling 14 and a time period of a pivoting back of the hydraulic machine 2 is taken into account. The maximum permitted 10% overpressure in a high-pressure accumulator 1 is then converted into a volume $\Delta V$. For the maximum delivery flow $\Delta Q$ of the hydraulic machine 2, the required response time $\Delta t$ for the pressure limitation according to the disclosure is $$\Delta t = \Delta V / \Delta Q.$$

The opening of the coupling 14 can be monitored by rotation speed sensors (not shown).

Furthermore the motor 16 can also be connected with the control unit 38 and controlled by this.

In the embodiment example it is not provided that the shut-off valve 8 is switched to the blocking position for the purpose of pressure shut-off, so the accumulator pressure can also be monitored redundantly by the pressure sensor 28 and by the further pressure sensor 32 which is connected to the line segment 4.

The two pressure sensors 28 and 32 can then also be used to monitor the shut-off valve 8. If the valve is actually open and different pressures are measured by the two pressure sensors, or if the shut-off valve is actually closed and the same pressures are measured, a fault has occurred.

The hydraulic arrangement according to the disclosure is used in particular in mobile transport and working machines, for example refuse collection vehicles, city buses or construction vehicles. For construction vehicles, as well as the combustion engine 16 or an electric motor or the entire vehicle, the working equipment or a turning gear can also apply a torque to the gear shaft 47 and hence drive the hydraulic machine 2.

The safety device can be tested regularly e.g. at each ignition start. For this for example the maximum permitted pressure in the hydraulic accumulator 1 can be set to atmospheric pressure. The power drivers for the actuators on the hydraulic machine 2 and on the coupling 14 should then switch off. If they do not, the test is not successful and a malfunction is indicated. Because of the cyclic monitoring, where applicable with the safety devices based on pressure-limiting valves, the prescribed annual test may be omitted.

The pressure energy stored in the hydraulic accumulator 1 can be used regeneratively to support the drive of the vehicle or the drive of working hydraulics. For this the hydraulic machine 2 is adjusted so that while retaining the direction of rotation, it now works as a hydraulic motor for which the hydraulic accumulator 1 constitutes the source of pressure medium and which via the coupling 14 can exert a torque on the gear shaft 47.

A hydraulic arrangement is disclosed with at least one pressure vessel connected with a hydraulic machine and with a safety device for the pressure vessel. This has a pressure sensor assembly for detecting a pressure in the pressure vessel and an electronic control unit connected with the pressure sensor assembly, via which the delivery quantity output by the hydraulic machine can be controlled.

The invention claimed is:

1. A hydraulic arrangement, comprising:

an electronic control unit;

a hydraulic machine operable as a pump and connected to the electronic control unit such that a displacement of the hydraulic machine is controllable by the electronic control unit;

a switchable coupling connecting the hydraulic machine and a drive, the switchable coupling further connected to the electronic control unit and configured to be controlled by the electronic control unit;

at least one hydraulic or hydropneumatic pressure vessel connected with the hydraulic machine; and a pressure sensor assembly connected to the electronic control unit and configured to detect a pressure in the pressure vessel, wherein the electronic control unit is configured to reduce the displacement of the hydraulic machine to null and to open the switchable coupling depending on the pressure detected in the pressure vessel.

2. The hydraulic arrangement as claimed in claim 1, wherein the pressure sensor assembly has two redundant pressure sensors.

3. The hydraulic arrangement as claimed in claim 1, wherein the hydraulic machine is configured to be driven by a motor and wherein the motor is connected with the control unit and is configured to be controlled by the control unit.

4. The hydraulic arrangement as claimed in claim 3, wherein the motor is an internal combustion engine or an electric motor.

5. The hydraulic arrangement as claimed in claim 3, wherein the hydraulic machine is an adjusting mechanism which is connected with the control unit, the adjusting mechanism having a stroke volume that is configured to be controlled by the control unit.

6. The hydraulic arrangement as claimed in claim 1, wherein the pressure vessel is a hydropneumatic high-pressure accumulator which is connected to the hydraulic machine via a high-pressure line, wherein a shut-off valve is arranged in the high-pressure line, and wherein in each case one pressure sensor assembly is arranged in the high-pressure line before and after the shut-off valve.

7. The hydraulic arrangement as claimed in claim 1, wherein a shut-off valve is arranged between the pressure vessel and the hydraulic machine, and wherein in each case one pressure sensor assembly is installed before and after the shut-off valve.

* * * * *